US005637335A

United States Patent [19]

Fond et al.

[11] Patent Number: 5,637,335

[45] Date of Patent: Jun. 10, 1997

[54] CAPSULE PACKAGE CONTAINING ROAST AND GROUND COFFEE

[75] Inventors: Olivier Fond; Petr Masek, both of Yverdon, Switzerland

[73] Assignee: Nestec S.A., Vevey, Switzerland

[21] Appl. No.: 899,341

[22] Filed: Jun. 16, 1992

[30] Foreign Application Priority Data

Jul. 5, 1991 [EP] European Pat. Off. ..... 91111209.2

[51] Int. Cl.[6] ..... B65B 29/02; B65D 85/00

[52] U.S. Cl. ..... 426/84; 426/77; 426/111; 426/112; 426/394

[58] Field of Search ..... 99/295, 302 R; 426/77, 433, 84, 111, 112

[56] References Cited

U.S. PATENT DOCUMENTS

| | | | |
|---|---|---|---|
| 1,377,316 | 5/1921 | Clermont | 99/295 |
| 1,412,388 | 4/1922 | Clermont . | |
| 2,186,087 | 1/1940 | Yates | 426/77 |
| 2,359,292 | 10/1944 | Barnett | 426/82 |
| 2,451,195 | 10/1948 | Brown . | |
| 2,899,886 | 8/1959 | Rodth | 99/295 |
| 3,083,100 | 3/1963 | Baran | 99/295 |
| 3,083,101 | 3/1963 | Noury . | |
| 3,384,004 | 5/1968 | Perlman et al. . | |
| 3,389,650 | 6/1968 | Michielsen | 426/433 |
| 3,445,237 | 5/1969 | Gidge | 99/295 |
| 3,446,624 | 5/1969 | Luedtke | 426/77 |
| 3,589,272 | 6/1971 | Bouladon et al. | 426/77 |
| 3,607,297 | 9/1971 | Fasano | 426/433 |
| 3,823,656 | 7/1974 | Vanderveken | 426/77 |
| 4,136,202 | 1/1979 | Favre | 99/295 |
| 4,254,694 | 3/1981 | Illy . | |
| 4,724,752 | 2/1988 | Aliesen et al. | 99/302 R |
| 4,735,719 | 4/1988 | Benedict | 99/295 |
| 4,800,089 | 1/1989 | Scott | 99/295 |
| 4,846,052 | 7/1989 | Favre | 99/295 |
| 4,852,333 | 8/1989 | Illy . | |
| 4,859,337 | 8/1989 | Woltermann | 426/79 |
| 4,983,410 | 1/1991 | Dinos | 426/77 |
| 4,995,310 | 2/1991 | Lijn et al. | 99/295 |
| 5,134,924 | 8/1992 | Vicker | 99/302 R |

FOREIGN PATENT DOCUMENTS

| | | | |
|---|---|---|---|
| 1198879 | 2/1958 | France | 426/77 |
| 2479674 | 10/1981 | France . | |
| 2327264 | 1/1975 | Germany | 426/77 |
| 0314618 | 2/1934 | Italy . | |
| 0527592 | 10/1972 | Switzerland . | |
| 939934 | 10/1963 | United Kingdom | 426/77 |
| 2023086 | 12/1979 | United Kingdom . | |
| 2183459 | 6/1987 | United Kingdom | 426/77 |

*Primary Examiner*—Steven Weinstein
*Attorney, Agent, or Firm*—Vogt & O'Donnell, LLP

[57] ABSTRACT

A capsule package which contains roast and ground coffee for preparation of a coffee beverage has body and membrane components. The body has a base portion capable of allowing flow of a coffee beverage therethrough, an annular sidewall portion which extends transversely from the base about a package body interior space and defines an opening which opposes the base portion, and a rim portion which extends about the opening and transversely from the sidewall portion in a direction away from the opening. The membrane has a peripheral portion which is sealed to the package body portion rim, a membrane sidewall portion which extends transversely from the membrane peripheral portion adjacent the package body sidewall portion into the package body interior space, and a membrane central portion which extends transversely from the membrane sidewall portion and is capable of allowing flow of a fluid therethrough for preparation of a coffee beverage, and the membrane is configured so that a package cavity is defined between the membrane central portion and the package body base portion for containing the roast and ground coffee. Each of the package body and the membrane are formed of a flexible material and are configured so that the package body sidewall portion and the membrane sidewall portion are independently deformable relative to each other longitudinally and laterally with respect to a longitudinal axis of the package body sidewall portion.

10 Claims, 3 Drawing Sheets

CAPSULE PACKAGE CONTAINING ROAST AND GROUND COFFEE

BACKGROUND OF THE INVENTION

The present invention relates to capsule package for containing a substance for preparation of a beverage in an extraction machine with a fluid under pressure.

There are several reasons for the use of capsules for the preparation of a beverage from a powder-form substance, above all in the field of espresso-type coffees extracted under pressure, namely, hygiene, optimal keeping of the coffee, ease of use, better control of the quality of the coffee obtained and good reproducibility of the extraction conditions.

These capsules can be made in an "open," form with permeable upper and lower faces to allow the extraction fluid to pass through.

In order to maintain the quality of the coffee by protecting it against moisture and oxygen, "open," capsules have to be wrapped in fluid-type bags or provided with fluid-tight peelable covers on both faces.

In order to satisfy the requirements of various countries concerning the recycling of packaging materials, there is a need for a new capsule design using lightweight materials, for example plastic films.

In order, on the other hand, to satisfy economic and commercial requirements also, the capsules should be able to be made on the same packaging machines and extracted in the same extraction machine.

Finally, to reduce the consumption of material in the manufacture of the capsules, the capsules themselves should be simplified. This can be done, for example, by eliminating the filter at the base of the capsule.

The use on ecological or economic grounds of thin flexible materials for the production of capsules, for example containing ground coffee and designed for extraction under the pressure of hot water, generally involves the problem of giving the capsules a predetermined shape to allow correct extraction of the powder-form substance and, above all, maintaining that shape after handling, transport and storage.

Now, in the interests of good extraction, the capsules must be able perfectly to follow the inner shape of the extraction system to avoid any preferential passage of water outside the layer, for example of coffee.

Filter paper capsules containing compacted ground coffee are described, for example, in Swiss Patent No. 527 592 and in European Patent Application Publication No. 0 272 432.

Compacted capsules of this type have disadvantages, namely:

- because the coffee has to be compacted, there is a risk that it may not be properly wetted during extraction, resulting in incomplete extraction;
- since the filter paper is not deformable, it can tear and thus jeopardize the fluid tightness of the extraction process; and
- the capsules require specific adaptors which exactly follow their shape to obtain the fluid-tightness required for extraction.

SUMMARY OF THE INVENTION

The problem addressed by the present invention was to provide an "open" capsule in the shape of a frustum or inverted frustum which would be made of flexible materials, which would retain its shape, particularly during extraction, so that extraction would take place correctly by passage of the extraction fluid without preferential flow paths through the layer of powder-form substance, and which would be able to be extracted in fluid-tight manner in conventional espresso machines without an adaptor.

The capsule package according to the invention has a body in the form of a frustum or inverted frustum which is provided with a rim and which contains a powder-form substance for the preparation of a beverage on a body cavity closed by a membrane.

It is characterized in that the body is deformable or extendable to allow exact adaptation to various extraction systems, in that the body and the membrane are made of a permeable flexible plastic material or in that the base of the body and the central part of the membrane are perforated or in that the membrane is made of filter paper.

DETAILED DESCRIPTION OF THE INVENTION

In a first embodiment, the sidewall of the body of the capsule package extends beyond the cavity containing the substance. Because it is flexible, the body is longitudinally and laterally deformable which enables the capsule package to be adapted to the filter support during extraction.

In addition, the capsule package has a wide rim so that extraction takes place in fluid-tight manner, the rim acting as the seal between the machine and the filter support.

In a second embodiment, the body, in its part adjacent the major base of the frustum, comprises a gusset, which allows extension of the body and ensures fluid-tightness of the extraction process.

In the embodiments mentioned above where the body is deformable and extendable, extraction can be carried out without modification of the components of the extraction system, i.e., it does not require an adaptor.

The capsule package according to the invention can also be extracted with the system comprising a grill which is the subject of applicants' European Patent Application No. 91 107 462. The capsule package can also be extracted in a conventional espresso coffee machine by means of a specific adaptor of the type described in the European patent applications filed by applicants on the same day as the present application under Nos. 91111210, 91111211 and 91111212.

The present invention also provides processes for the production of the capsule package wherein the body and the rim are thermoformed from a first film, the package body interior space thus formed is filled with a powder-form composition for a beverage and the composition is tamped in a stream of inert gas, the membrane formed from a second film is sealed to the body of the capsule package, and the base of the body and, optionally, the membrane, is/are perforated and the capsule package is cut out.

The invention is described in more detail in the following with reference to the accompanying drawings which illustrate various embodiments of capsules packages and processes for making the same.

DETAILED DESCRIPTION OF THE DRAWINGS

Figure 1:
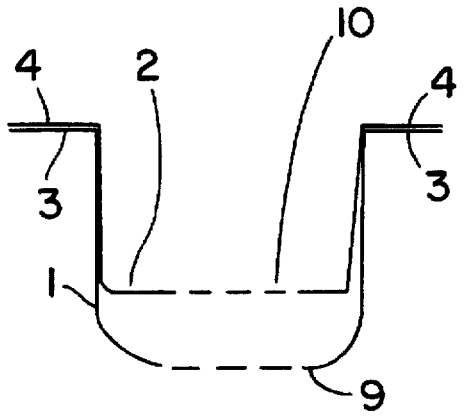
FIGS. 1, 2 and 3 are median diagrammatic sections through various capsule packages in the form of inverted frustums.
Figure 2:
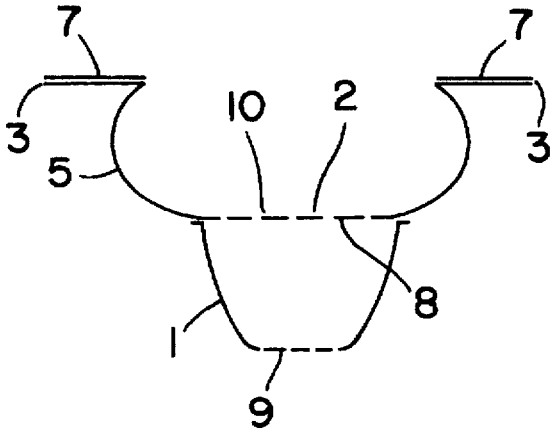
Figure 3:
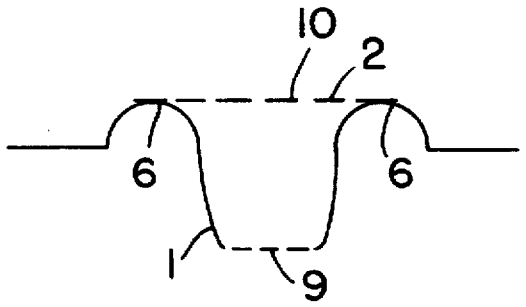

In FIGS. 1 to 3, the body 1 and the membrane 2 of the capsule packages are made of thin flexible films of plastic material.

In FIG. 1, the membrane and the body have been thermoformed and have wide heat-sealed rims 3 and 4.

In FIG. 2, the body has a concave gusset 5 on its annular wall. In FIG. 2, the peripheral part 7 of the membrane is welded to the rim 3 of the body and is in the form of a ring after cutting, although its central part 8 is welded to the inner rim of the gusset 5.

In FIG. 3 the gusset 6 is convex, and the precut membrane 2 is welded to the top of the gusset 6. Alternatively, the membrane 2 may be cut out after welding beyond the gusset 6.

The capsule packages have perforations 9 in the base of the body and perforations 10 in the central part of the membrane.

Figure 4:
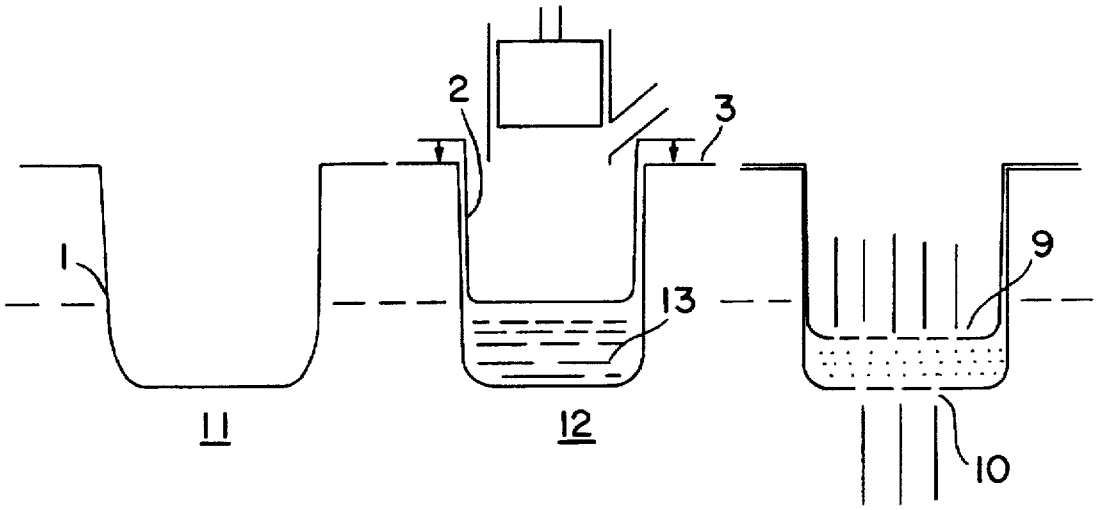
FIGS. 4 to 6 diagrammatically illustrate processes the process by which the capsule packages are produced.

In FIG. 4, the body 1 is formed by thermoforming at 11. Ground coffee 13 is introduced into the body interior space formed by the base and annular sidewall and tamped at 12, after which the thermoformed membrane 2 is welded to the rim 3 of the body.

Introduction and tamping of the coffee and welding of the membrane take place in a nitrogen atmosphere.

The base of the body and the membrane are perforated with hot needles in their central part (9,10). The illustrated process is used for the production of the capsule shown in FIG. 1. Thus, the annular sidewall and rim of the capsule package body 1 are not perforated to allow for flow of a coffee beverage as is illustrated in FIG. 1 so that the coffee beverage is contained by the sidewall.

Figure 5:
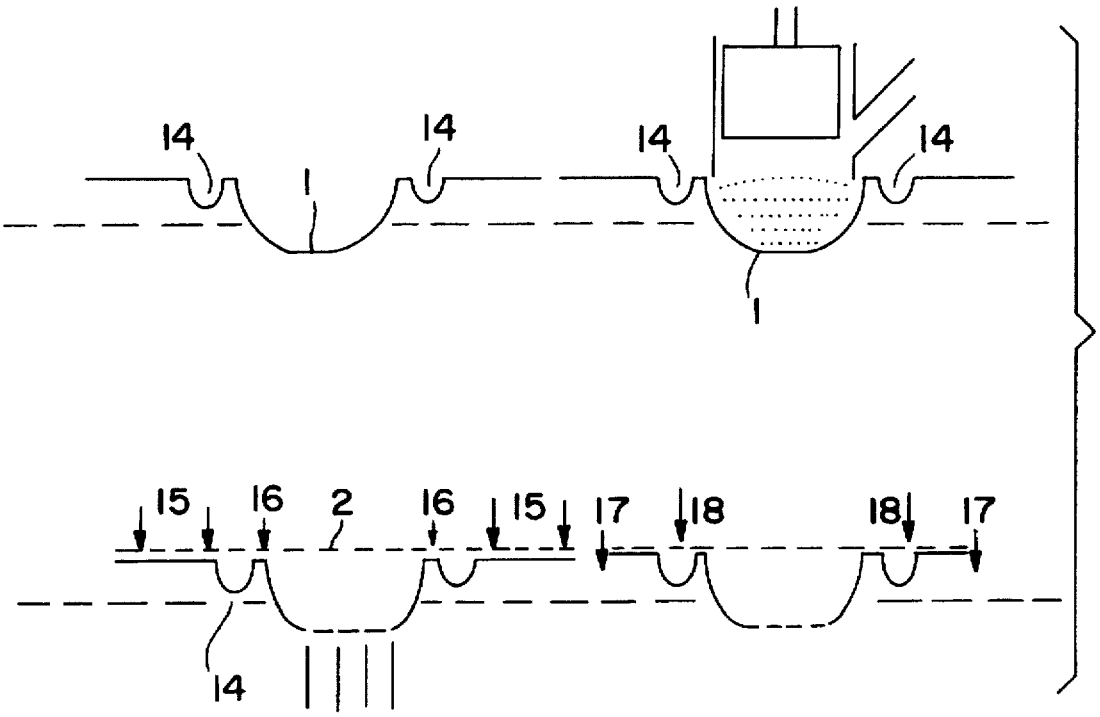

In FIG. 5, the body 1 is thermoformed at the same time as an annular body gusset 14. The capsule package body interior space is then filled with ground coffee which is then tamped. The base of the body is then perforated, after which a membrane 2 (perforated or permeable) is welded around the ring-shaped welding zones 15 and 16. The capsule package is then cut out along the cutting lines 17 and 18. An annular gusset 14 is thus created, allowing extension of the capsule package body and adaptation thereof to various filter supports. At the same time, a ring 7 (FIG. 2) is formed at the major base of the frustum of the body which enables the capsule package to retain its general shape while remaining sufficiently flexible. In addition, the fluid-tightness of the extraction process is thus ensured. This process is used for the production of the capsule package illustrated in FIG. 2.

Figure 6:
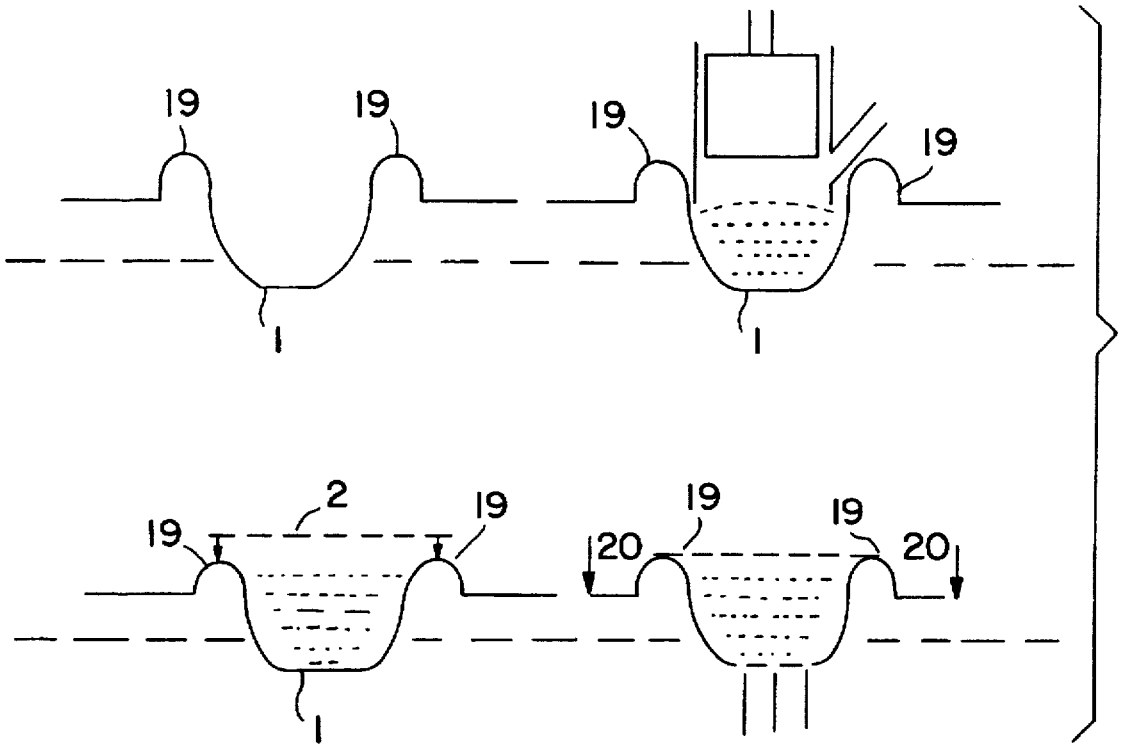

The process illustrated in FIG. 6 differs from the process illustrated in FIG. 5 in the fact that the gusset formed is convex. In addition, the membrane 2 is precut and then welded to the gusset, and the capsule package body interior space being filled to the top 19 of the gusset. Alternatively, the membrane can be welded and then cut out beyond the gusset. Finally, the capsule package is cut out in the arrowed direction 20. In a variant of this process which has not been shown, the precut membrane could be similarly welded to the inner rim of a concave gusset, or the membrane could be even welded to the inner rim of the gusset and then cut out beyond the gusset.

The thin and flexible walls of the body and the membrane may be made of a thermoformable single-layer or multilayer plastic material, such as polyethylene, polyamide, polypropylene or a polyester, for example polyethylene terephthalate, for example between 20 and 150 μm in thickness, or of a cellulose-based material, such as a composite of paper, for example weighing between 12 and 25 g/m$^2$, and a plastic material of the type described above, for example between 10 and 50 μm in thickness.

As described above, the base of the body and the membrane are perorated at their centres. The perforations may be wide open or closed in appearance. In the latter case, the capsule package will be extracted with a specific filter support equipped with fins on the flow grill of which the function is to enlarge the slots under the effect of the pressure.

The body and the membrane may also be made of a complex of woven or unwoven polyester or propylene, for example weighing between 15 and 40 g/m$^2$. The membrane can also be made of filter paper weighing 15 to 40 g/m$^2$ in the case of the versions shown in FIGS. 2 and 3.

In all its versions described herein, the capsule package according to the invention may vary in size according to the volume of beverage to be prepared. For example, the dose of coffee in the capsule package may vary from 5 to 20 g, the diameter of the capsule package is between 2.5 and 8 cm and the thickness of the layer of coffee is between 10 and 25 mm.

The capsule package is filled with a powder-form composition for the preparation of a beverage. This substance is peferably roasted and ground coffee, although it may also be tea, soluble coffee, a mixture of ground coffee and soluble coffee or a chocolate-flavoured product.

In every case, the extraction fluid will be vertically directed so that it passes through the entire layer of powder-form material without any danger of lateral flow paths being created.

To enable the coffee to keep, the capsule packages according to the invention will be individually wrapped in a thin material forming a fluid-tight barrier against oxygen and moisture, for example a copolymer of vinyl alcohol and ethylene, optionally filled with silica or metallized, a polyvinylidene chloride or a laminate of aluminium, paper and a plastic material.

We claim:

1. The combination of a capsule package and a roast and ground coffee composition contained therein wherein the composition consists essentially of roast and ground coffee for preparation of a coffee beverage:

wherein the capsule package consists of:

a package body for containing the roast and ground coffee wherein the package body has a base portion, an annular sidewall portion and a rim portion and wherein the base portion is capable of allowing flow of the coffee beverage therethrough, the sidewall portion extends transversely from the base portion about a package body interior space and defines an opening which opposes the base portion and the rim portion extends about the opening and transversely from the sidewall portion in a direction away from the opening;

a membrane which has a peripheral portion, a sidewall portion and a central portion, wherein the membrane peripheral portion is sealed to the package body rim portion, the membrane sidewall portion extends transversely from the membrane peripheral portion adjacent the package body sidewall portion into the package body interior space and the membrane central portion extends transversely from the membrane sidewall portion and is capable of allowing flow of a fluid therethrough for preparation of a coffee beverage and wherein the membrane sidewall portion extends for a distance so that the membrane central portion is positioned within the package body interior space at a position displaced from the package body base portion for defining a package cavity between the membrane central portion and the package body base portion for containing the roast and ground coffee composition;

wherein the roast and ground coffee composition is contained in the package cavity; and wherein both the package body and the membrane are comprised of a flexible material and the package body base and sidewall portions and the membrane sidewall and central portions are configured so that the package body sidewall portion and the membrane sidewall portion are independently deformable relative to each other longitudinally and laterally with respect to a longitudinal axis of the package body sidewall portion.

2. A capsule package according to claim 1 wherein the package body portion base has perforations therethrough for flow of the coffee beverage therethrough.

3. A capsule package according to claim 2 wherein the package body portion is comprised of a layer of thermoformable plastic film and a layer of cellulose-based composite paper wherein the plastic film layer has a thickness of between 10 μm and 50 μm and the composite paper layer has a weight of between 12 $g/m^2$ and 25 $g/m^2$.

4. A capsule package according to claim 1 wherein the package body portion base has perforations therethrough for flow of the coffee beverage therethrough and wherein the membrane central portion has perforations therethrough for flow of the fluid therethrough for preparation of the coffee beverage.

5. A capsule package according to claim 1 wherein the package body portion is comprised of thermoformable plastic film having a thickness of between 20 m and 150 μm and the package body portion base has perforations therethrough for flow of the coffee beverage therethrough.

6. A capsule package according to claim 5 or 3 wherein the membrane is comprised of thermoformable plastic film having a thickness of between 20 μm and 150 μm and the membrane central portion has perforations therethrough for flow of the fluid therethrough for preparation of the coffee beverage.

7. A capsule package according to claim 5 or 3 wherein the membrane is comprised of thermoformable plastic film and cellulose-based composite paper layers wherein the plastic film has a thickness of between 10 μm and 50 μm and the composite paper has a weight of between 12 $g/m^2$ and 25 $g/m^2$ and the membrane central portion has perforations therethrough for flow of the fluid therethrough for preparation of the coffee beverage.

8. A capsule package according to claim 1 wherein the membrane is comprised of filter paper.

9. A capsule package according to claim 1 wherein the package body portion sidewall forms a solid surface so that the coffee beverage is contained by the package body portion sidewall.

10. A capsule package according to claim 1 wherein the membrane and package body are sealed together only at a position of the membrane peripheral portion and the package body rim portion.

* * * * *

UNITED STATES PATENT AND TRADEMARK OFFICE

CERTIFICATE OF CORRECTION

PATENT NO. : 5,637,335
DATED : June 10, 1997
INVENTOR(S) : Olivier FOND, et al.

It is certified that error appears in the above-indentified patent and that said Letters Patent is hereby corrected as shown below:

Column 3, line 27, after "beverage" insert --therethrough and the sidewall therefore forms a solid surface,--.

Signed and Sealed this
Seventh Day of October, 1997

*Attest:*

*Attesting Officer*

BRUCE LEHMAN

*Commissioner of Patents and Trademarks*